United States Patent [19]

Weeter

[11] 4,347,899

[45] Sep. 7, 1982

[54] DOWNHOLD INJECTION OF WELL-TREATING CHEMICAL DURING PRODUCTION BY GAS LIFT

[75] Inventor: Robert F. Weeter, Carrollton, Tex.

[73] Assignee: Mobil Oil Corporation, New York, N.Y.

[21] Appl. No.: 267,301

[22] Filed: May 28, 1981

Related U.S. Application Data

[63] Continuation-in-part of Ser. No. 218,149, Dec. 19, 1980, abandoned.

[51] Int. Cl.[3] ..... E21B 43/00

[52] U.S. Cl. ..... 166/310; 166/244 C; 166/371; 166/372; 417/54

[58] Field of Search ..... 166/244 C, 310, 312, 166/371, 372, 374, 67; 417/54, 55

[56] References Cited

U.S. PATENT DOCUMENTS

| | | | |
|---|---|---|---|
| 1,602,190 | 10/1926 | Eddy et al. | 166/371 X |
| 2,380,639 | 7/1945 | Eris | 417/55 |
| 2,654,436 | 10/1953 | Carlisle et al. | 166/310 |
| 3,090,316 | 5/1963 | Montgomery | 166/372 |
| 3,215,087 | 11/1965 | McLeod, Jr. | 417/55 |
| 3,566,970 | 3/1971 | Crow et al. | 166/244 C X |
| 4,031,955 | 6/1977 | Ledet | 166/244 C X |

*Primary Examiner*—James A. Leppink
*Assistant Examiner*—George A. Suchfield
*Attorney, Agent, or Firm*—Charles A. Huggett; James F. Powers, Jr.; Lawrence O. Miller

[57] ABSTRACT

A liquid well-treating chemical composition is injected into the production tubing during gas lift operations by providing a differential pressure operated valve downhole from the lowermost gas lift flow valve and maintaining sufficient liquid head of the chemical composition in the annulus to open the valve and cause the liquid chemical composition to pass into the interior of the production tubing.

14 Claims, 1 Drawing Figure

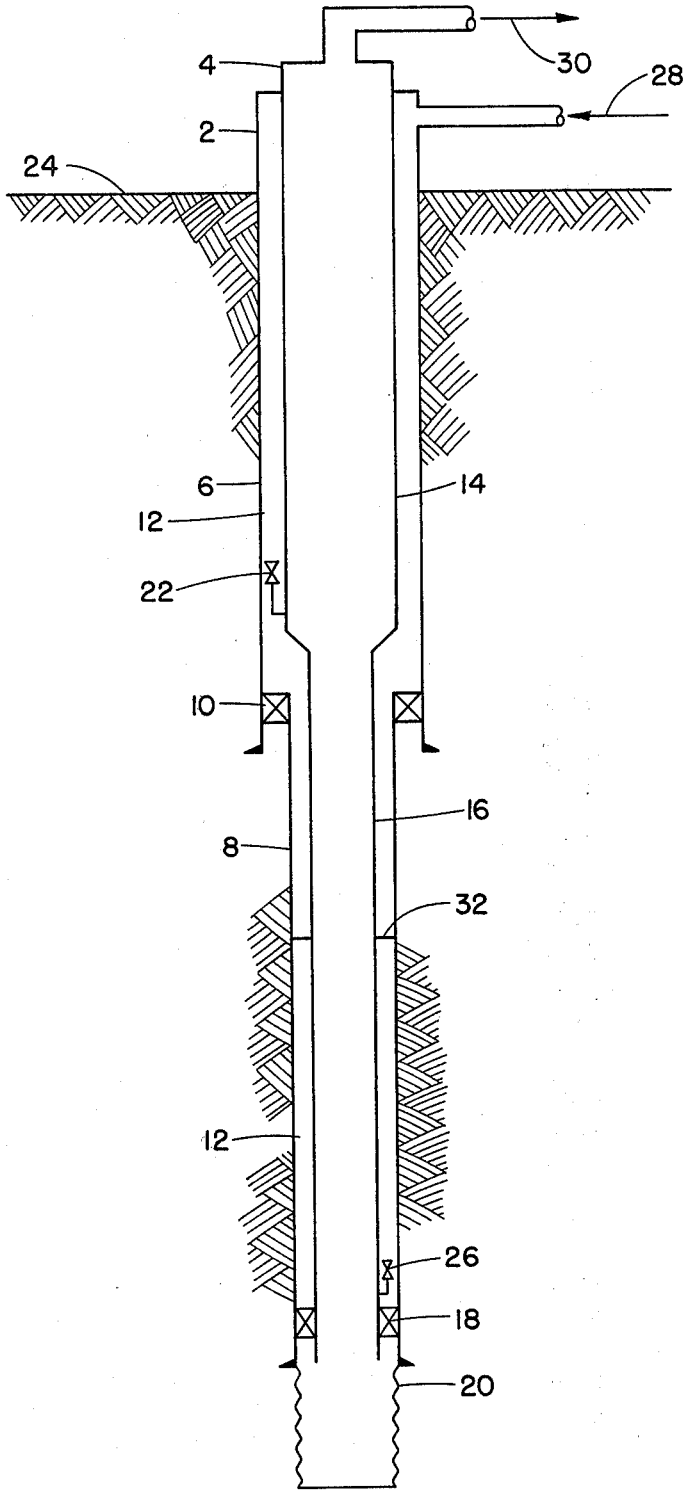
4
30
28
2
24
6
14
12
22
10
16
8
32
12
26
18
20

DOWNHOLD INJECTION OF WELL-TREATING CHEMICAL DURING PRODUCTION BY GAS LIFT

CROSS-REFERENCE TO RELATED APPLICATION

This is a continuation-in-part of application Ser. No. 218,149, filed Dec. 19, 1980, now abandoned.

BACKGROUND OF THE INVENTION

1. Field of the Invention

This invention relates to the gas lift method of obtaining oil from a producing well. More particularly, it relates to effecting corrosion inhibition, scale control, paraffin control and the like during gas lift producing operations. This invention especially relates to the downhole injection of well-treating chemical compositions during gas lift operations to reduce corrosion and to control scale and paraffin wax formation and the like in the well casing, the tubing and their attendant equipment.

2. Description of the Prior Art

Gas lift is a well known technique applied to an oil producing well. The most commonly employed type of gas lift in use today is termed flow valve gas lift because of, as the name implies, the use of special flow valves which make gas lift a self-contained method of production applicable under a very wide range of well conditions. A flow valve is a device which controls the injection of high pressure gas into the fluid contained within the tubing. Flow valves are available in a variety of operating modes. The differential pressure flow valves are spring loaded and remain closed until the pressure in the tubing becomes sufficiently larger, with the help of the spring tension, to overcome the casing pressure causing the valve to open admitting gas from the annulus into the tubing. As the valve opens, the casing pressure is larger than the tubing pressure by the differential of the spring tension. Specific gravity differential flow valves are designed to open as a result of the difference in specific gravity of the fluid in the tubing and a special light fluid contained within the valve. If the tubing fluid is light, the valve remains closed, if it is heavy, the valve opens. Other flow valves may be controlled from the surface by the well operators usually by means of some type of mechanical linkage or by changing the annulus pressure which in turn causes a movement of a prepressured metallic bellows connected to the stem of the flow valve. Currently, the surface controlled pressure operated valves are being employed in a majority of gas lift operations.

The flow valve has heretofore been located on the outside of the tubing string. Thus when the tubing is placed in position inside the well casing the flow valve is located in the annulus space. More recently, flow valves have been made retrievable by being located in pockets on the inside of the tubing string. A multiplicity of flow valves may be employed, each at a different level on the tubing to permit variation in the well's production by selective gas injection at a higher or lower positioned valve, as conditions warrant.

Production during gas lift may be either continuous or intermittent. In continuous flow, the well is unloaded to a certain flow valve and at this point equilibrium is established between casing pressure, valve differential, back pressure at the gas injection point, the rate of production and the flow from the reservoir into the well bore. The flow valve remains open, gas is continuously injected into the annulus and the aerated column of fluid is produced at the well head.

Where well conditions will not sustain continuous production, intermittent gas lift is often employed. Gas is introduced into the well casing intermittently, with well fluid accumulating in the tubing between cycles. When the gas is admitted to the tubing through the flow valve, it brings a slug of oil to the surface through the combined actions of displacement and gas expansion.

In oil fields, the production of petroliferous fluids from subterranean formations by means of gas lift is often accompanied by extremely severe corrosion of metal apparatus contacting the fluid produced. In some instances it is found that these fluids contain substantial amounts of organic acid materials such as acetic acid and/or carbon dioxide in the form of carbonic acid. These fluids are classified in the petroleum art as "sweet". In other cases the fluids include corrosive sulfides such as alkali metal and alkaline earth metal sulfides and hydrosulfides, hydrogen sulfide and/or organic sulfides. The sulfide containing fluids are normally designated as "sour". In the absence of some method of retarding the corrosive attack by these sweet and sour fluids, the life of oil well equipment is materially shortened.

A wide variety of chemical corrosion inhibitors has been developed heretofore to reduce the metal corrosion experienced in oil fields. Inhibitors have been developed for the specific corrosion conditions found in a particular field by employing either a single chemical or a mixture of chemicals. Corrosion inhibitors well known in the art are available commercially to combat the corrosion caused by either the sweet or sour fluids and in many instances significant success has been obtained.

A variety of techniques has been employed heretofore to introduce the corrosion inhibitors into the oil production system. It is usually desirable to provide the inhibitor composition in a form readily dispersible in oil. One convenient technique is to form a solution of the inhibitor in oil or other hydrocarbon solvent. The solution may then be injected or poured into the annular space between the casing and the tubing string. Where the inhibitor is a liquid, it may also be employed in its undiluted form if the desired quantity can be accurately measured into the well.

Another method of adding a corrosion inhibitor to a corrosive well fluid is to add the inhibitor in the form of a weighted and disintegratable stick. Such a stick is formed by mixing the inhibitor with an oil soluble or water soluble binder, as the conditions require, in a weighing compound such as barium sulfate or lead oxide. The stick is dropped into the well where solution and emulsification occur.

Metal corrosion can develop during gas lift operations. A number of techniques has been developed heretofore to inhibit this corrosion including squeeze, inhibitor sticks and continuous injection down a small string in the production tubing. Squeeze requires shutting the well in, pumping the inhibitor and carrier downhole and displacing the mixture into the formation. Inhibitor squeeze may cost as much as several days production and often must be done frequently. For highly productive wells such as Berri platforms in Saudi Arabia, a four day yearly shutdown can cost 200,000 barrels of lost production worth about six million dollars per year. The use of inhibitor sticks in the tubing during gas lift is unreliable and slow and thus has not met with a great deal of success. Although continuous injection of inhibitor down a small string in the production tubing provides an accurate means of controlling the introduction of inhibitor into the system, the small string is subject to being pinched, particularly when the string is being pulled since few, if any, well bores are truly vertical.

Other problems closely related to that of metal corrosion may also occur during production operations and may be severe enough to require shutting the well in to take corrective measures. Paraffin wax and scale can form on the metal surfaces of the production tubing, the well casing and other production equipment causing an undesirable reduction in the production rate.

Paraffin wax is often found in petroliferous fluids in subterranean formations. Although this wax is usually soluble under downhole conditions, during production the wax may solidify in a zone of reduced pressure causing undesirable plugging conditions. Liquid solvents have been employed heretofore in production operations to dissolve the solidified wax or to prevent its formation. These techniques are known in the art as paraffin control.

Deposits of inorganic compounds, known as scale, can also take place during production operations, including gas lift operations, causing serious reductions in the production rate. These deposits, which fall out of solution during production and form on the surfaces of the casing, the tubing and other equipment, may comprise such compounds as calcium carbonate, calcium sulfate, barium sulfate, strontium sulfate, magnesium hydroxide and the like. Control of this scale by chemical means has been developed over the years and is well known. Inorganic and organic chemicals have been utilized heretofore to obtain a measure of control over this scale formation. These scale control chemicals have been utilized per se if in liquid form. Otherwise it is usually desirable to form a solution or a dispersion of the scale control chemical with a liquid carrier such as oil or other convenient solvent.

Some of the techniques utilized for providing corrosion inhibitors downhole in the production system may likewise be employed with paraffin control solvents and scale control chemicals. Thus, the well can be shut in and the appropriate material, in liquid form or together with a liquid carrier, may be pumped downhole during the delay in production. Production delays whether for paraffin control or scale control are as undesirable and as costly as they are when occasioned by corrosion inhibition measures, as discussed above.

Since corrosion inhibition, paraffin control and scale control can often be effected by the downhole introduction of a liquid, methods for effecting the introduction of one active ingredient are usually equally applicable to the others. Thus, whether a paraffin control solvent, a mixture of a scale control chemical and liquid carrier or a corrosion inhibitor in a carrier is involved, the same equipment and processes may be employed. Hereinafter, the term "liquid, well-treating chemical composition" or a shortened version "well-treating composition" will be used collectively to include a paraffin control solvent, a scale control chemical, a corrosion inhibitor or a like chemical utilized to treat a downhole condition in a production well, whether the chemical is a liquid or is utilized in a liquid form, viz., solution, dispersion and the like.

A need exists for a method of introducing liquid, well-treating chemical compositions at a controllable rate into oil well production equipment during gas lift operations, preferably, without interfering with production and by a method which is not subject to frequent mechanical failure.

It is an object of this invention to provide a method for introducing well-treating compositions into oil well production equipment during gas lift operations.

It is another object of this invention to introduce well-treating compositions into oil wells during gas lift operation without interrupting oil production.

It is a further object of this invention to provide a method of introducing well-treating compositions at a controllable rate into oil well production equipment during gas lift operation.

It is still another object of this invention to provide a method of production well chemical treatment during gas lift operation which is not subject to frequent mechanical failure.

SUMMARY OF THE INVENTION

In accordance with the present invention, it has been found that a well-treating composition may be continuously or intermittently introduced into an oil well during gas lift operations by introducing a liquid well-treating chemical composition into the annular space of the well where it flows to the bottom of the well bore and enters the tubing string through a differential pressure valve.

The process of this invention is directed to an improvement in the production of oil from an oil well by gas lift operations of the type wherein:

(1) recovery gas is introduced into the annular space between a well casing and a tubing string located within said casing, said tubing string provided with at least one gas lift flow valve intermediate the well head and the well bore bottom, and (2) gas pressure in the annular space is maintained at a level effective to cause the flow valve to open whereby the recovery gas causes oil to be produced at the well head, which comprises:

(a) providing a liquid well-treating chemical composition injection valve on said tubing string downhole from the lowermost gas lift flow valve, said well-treating composition injection valve being operatively opened by the pressure difference between the annular space and the tubing string at the location of the well treating composition injection valve, and (b) during the oil production of step (2), injecting into the annular space a well-treating effective amount of a liquid, well-treating chemical composition, said composition providing a liquid head in the annular space effective to cause the well-treating composition injection valve to open and the well-treating composition to pass into the tubing string.

BRIEF DESCRIPTION OF THE DRAWINGS

The drawing is a representation of an oil well incorporating an embodiment of this invention.

DESCRIPTION OF THE PREFERRED EMBODIMENTS

The present invention relates to a process for inhibiting metal corrosion, controlling paraffin and/or scale deposition and the like in oil well equipment during gas lift operations. In particular, it relates to injecting a well-treating composition downhole during oil production by means of conventional gas lift procedures. Corrosion protection, paraffin control, scale control and the like are obtained for the exterior of the tubing, the interior of the casing and most of the interior of the tubing.

The well-treating chemical is most conveniently supplied as a liquid or as a solution or mixture with a liquid carrier and is injected into the annular space between the well casing and the production tubing. The well-treating composition fills the annular space to a point below the lowermost of the multiplicity of gas lift flow valves conventionally located on the outside of the tubing string. A pressure differential operated valve located on the tubing string below the lowermost of the gas lift flow valves and, conveniently, near the bottom of the well bore, is designed to open when the downhole conditions are such as to permit the liquid, well-treating chemical composition to pass from the annular space into the interior of the production tubing. This valve is termed the well-treating composition injection valve. In this fashion, protection is provided for the interior of the casing and the outside of the tubing when the well-treating composition is injected downhole and is maintained in the annular space to provide a liquid head on the well-treating composition injection valve. Protection is also provided for the interior of the production tubing when the well-treating composition passes through the well-treating composition injection valve and is carried up to the wellhead with the oil being produced. The interior section of the tubing below the well-treating composition injection valves, i.e., for a few feet above and through the packer and through the tail pipe, may be provided with a corrosion-proof lining since corrosion inhibitor will not flow past this section of the tubing when it is the active ingredient in the well-treating composition.

The valve which serves as the well-treating composition injection valve must be capable of being opened during gas lift operations to permit the passage of the well-treating composition from the annular space into the interior of the production tubing. In addition, this valve must also function as a check valve since the production stream must not be permitted to enter the annulus. Valves conventionally employed as flow valves during gas lift may be employed as the well-treating composition injection valve, particularly those which are opened and closed by a differential pressure operating means. Such valves are well known in the art and are commercially available in a variety of sizes, pressure ranges and materials of construction.

In general, the well-treating composition will be added until it fills the annulus to a point near but below the lowermost gas lift flow valve. The column of well-treating composition in the annulus will be heavier than the column of production fluid below the operating gas lift valve. Thus the liquid level in the annulus will be somewhat lower than the operating gas lift valve. The level in the annulus will be determined by the weight of the column of well-treating composition and the pressure drop across the gas lift valve balanced against the weight of the production column and the pressure drop across the well-treating composition injection valve at the bottom of the tubing.

When the well-treatment process is the corrosion inhibition of the production equipment, the process of this invention may normally be practiced utilizing any of the commercially available corrosion inhibitors or mixtures thereof which will inhibit the corrosiveness of the particular well fluids of concern. The means of selecting these inhibitors will be dependent upon the sweetness or sourness of the well fluids as well as the materials of construction employed for the well casing, the production tubing and attendant equipment. Such procedures are well known in the art. Since the corrosion inhibitor will be employed downhole, its vapor pressure should be such that significant amounts of it should not vaporize under the conditions at the downhole locations where corrosion protection is to be provided.

The corrosion inhibitor is most conveniently employed when practicing the process of this invention when admixed with a liquid carrier. The carrier may be an oil or other inert hydrocarbon solvent. Although petroleum oils are usually the most economical diluent for the corrosion inhibitor, other diluents or solvents which are themselves oil soluble may be employed, for example, solvents such as kerosene, benzene, methyl alcohol, ethyl alcohol, isopropyl alcohol and the like. The carrier should not, however, vaporize when it is downhole so that the carrier should have a vapor pressure effective to substantially prevent vaporization of the carrier under the downhole conditions it will encounter.

In effecting control of paraffin wax deposition in production equipment, such solvents as carbon disulfide, carbon tetrachloride, gasoline and the like have been employed heretofore. These solvents may likewise by employed as the active ingredient in the process of this invention when the well-treating function is paraffin control.

Similarly, the chemicals and liquids employed in the art for scale control may be employed as the well-treating chemical composition of the present invention to control scale deposition during gas lift operations. Illustrative scale control chemicals include inorganic and organic phosphites, phosphates, phosphonates and the like. These active ingredients may be employed per se if in liquid form or incorporated in a carrier such as oil or equally convenient solvent to provide a liquid solution or dispersion. The diluents or solvents listed hereinbefore for use with corrosion inhibitors may also serve as the carrier for the scale control chemical.

When supplying the well-treating composition downhole, the amount of the composition should be a "well-treating effective amount" e.g., the composition should contain an amount of the active ingredient sufficient to effect corrosion inhibition, where the active ingredient is a corrosion inhibitor; to control the deposition of paraffin wax, where the active ingredient is a paraffin control solvent; to control the deposition of scale, where the active ingredient is a scale control chemical; or to treat an undesirable downhole condition where a chemical will serve as an active ingredient to modify, relieve or correct the downhole condition.

In the following description of the subject invention, a mixture of a corrosion inhibitor and a liquid carrier will constitute the liquid, well-treating chemical composition. The corrosion inhibitor is, of course, the active ingredient. This has been done to simplify the description and for illustrative purposes as those skilled in the art will understand that other liquid compositions to effect scale control, paraffin control and the like may be employed in a similar fashion to likewise achieve the desired results.

The process of this invention may be described with reference to the drawing. An oil production well, consisting of a casing 2 and production tubing 4 located therein, is producing oil by means of gas lift operations. Well casing 2 consists of larger diameter section 6 and smaller diameter section 8 joined together by packer 10. The space between well casing 2 and production tubing 4 is termed annulus or annular space 12. Production tubing 4 consists of larger diameter tubing section 14, and smaller diameter tubing section 16. Packer 18 seals the lower end of production tubing 4 at well bore bottom 20. Gas lift flow valve 22 is located on production tubing 4 extending into annulus 12. A series of flow valves is often provided on the production tubing for use in gas lift productions. Valve 22 is the lowermost of these gas lift flow valves and is the only one represented in the drawing, it being understood that other flow valves can be positioned between valve 22 and well head 24. Inhibitor injection valve 26 is located on production tubing 4 and extends into annulus 12. Injection valve 26 is positioned below flow valve 22, preferably in the vincinity of packer 18 and well bore bottom 20.

During production by gas lift, recovery gas is injected through line 28 into annular space 12 to provide sufficient gas pressure to cause gas to enter the tubing when flow valve 22 is open, admitting gas to the interior of production tubing 4. The recovery gas passes up tubing 4 carrying well fluids, including oil, to well head 24 where it passes through line 30 for separation and recovery.

Corrosion inhibition is provided during gas lift by injecting a mixture of corrosion inhibitor and liquid carrier into line 28 where the recovery gas carries it downhole into annular space 12. In the annular space the liquid mixture forms in lower portion 18 to 32 of casing 2 producing a liquid head. Upper surface 32 of the mixture is located at a point below flow valve 22. The differential pressure required to operate inhibitor injector valve 25 has been selected so that when the liquid head of the inhibitor mixture plus the pressure drop across gas lift valve 22 equals the liquid head in production tubing 4 from the location of gas lift valve 22 to well bore bottom 20 plus the pressure drop across inhibitor injector valve 26, the system is in equilibrium and injection valve 26 opens. With injection valve 26 open, the inhibitor mixture can be introduced at a constant rate at well head 24 and will pass through injection valve 26 into production tubing 4 at the same rate. As the inhibitor mixture passes downhole through annulus 12 and back up the well head 24 through production tubing 4, it contacts the ferrous metal surfaces providing the metal surfaces of casing 2 and tubing 4 with corrosion protection.

It often happens that downhole conditions will vary from those for which a particular corrosion inhibition process has been designed in accordance with the practice of this invention. Thus if the level of the liquid head of the corrosion inhibitor should rise above the location of a gas lift flow valve, at least some of the corrosion inhibitor may pass into the production tubing through a flow valve rather than through the corrosion inhibitor injection valve. This could cause a serious reduction in the corrosion protection provided for the interior of the production tubing located below the flow valve of concern. One effective mean to determine the amount of inhibitor passing through a flow valve is as follows:

1. The inhibitor injection valve should be retrievable and be designed to be plugged or replaced by a plug.
2. Pressure the annulus with gas lift gas.
3. Pump inhibitor into the annulus at a rate of 2 quarts of neat inhibitor per 100 bbl of liquids production for three days. Monitor the inhibitor return.
4. Calculate the percentage of inhibitor lost to the gas stream.
5. If the return is above 25% of the total injected, dilute the inhibitor with produced oil, with water removed, at a 4/1 ratio of oil to inhibitor using a separate pump for each liquid and keeping the inhibitor injection at 1 quarts/100 bbl.
6. After three days, again check inhibitor concentration.
7. Add more produced oil until inhibitor concentration in the produced liquids drops to 10%, if practical. The difference in 10% vs 25% is occasioned by not requiring injection of produced oil vs varying the amount of produced oil injected.
8. Pump inhibitor (and produced oil if necessary) into the annulus in the amount calculated to give returns from the injector valve at the packer.
9. Start injection in the required amount of inhibitor or inhibitor and produced oil.
10. If the use of produced oil is objectionable, use another suitable diluent.
11. On a monthly basis, check the feed of inhibitor through the injection valve at the packer by adding the inhibitor carrier only for one hour and checking inhibitor returns. If the returns drop dramatically, the injection valve has ceased to function, the annulus has filled and all inhibitor return is through the gas lift valve.
12. The inhibitor injection valve must be pulled and repaired.
13. Use conventional monitoring devices including tubing calipers and ultrasonic thickness measurements on the flowlines to determine effectiveness of the inhibitor, and adjust inhibitor feed rate accordingly. Two quarts/100 bbl probably is higher than necessary. After wireline work, one drum of inhibitor should be injected immediately to repair the damaged inhibitor film.

The following example, based on the Berri platforms in Saudi Arabia, illustrates the calculations involved in designing a corrosion inhibition process in accordance with this invention. The example below will make reference to the drawing to facilitate the description.

A gas lift valve 22 will be set at 5325 feet, at which depth the tubing pressure under gas lift will be 1904 psi with 10% water cut. The surface gas injection pressure is 2000 psi maximum and the gas pressure required in the annulus at 5325' feet is 2045 psi. To attain this, the surface pressure required is 1447 psi.

The flowing pressure at well bore bottom 20 (8044 ft. subsurface) is calculated as 3143 psi. Tubing pressure at the gas lift valve 22 (5325 ft.) is as follows for change in water cut:

10%—1904
20%—1918
30%—1934
40%—1951
50%—1976

The density of gas from 5325' to 7000' will be approximately the same as the density at 5325'. To obtain a feasibility calculation, an ideal gas with an average specific gravity of 0.89 will be used. when the surface pressure is raised from 1447 psi to the maximum available, 2000 psi, the pressure at 5325' is raised 555 psi or to 2600 psi. The effective weight of the lifted column of fluid is approximately 0.46 psi/ft., or somewhat heavier than water, in the zone from 8055' to 5325' or a total of 3143−1905=1238 psi. Part of this apparent density is pressure drop due to friction. Assume that a column of inhibitor weighs 0.409 psi/ft. A column of inhibitor from 5325' to the well bore bottom would exert a pressure of 0.409×(8044'-5325') or 1112 psi. If a differential of (1239-1112)=127 psi or more is kept across gas lift valve 22 with no pressure drop across inhibitor injection valve 18, and the inhibitor level is kept up to the gas lift valve, the system would be in equilibrium. From this it appears that more than 127 psi pressure drop must be maintained across gas lift valve 22.

Assuming that 2045 psi is maintained at the annulus side of gas lift valve 22 and 1976 psi, representing a 50% water cut, on the tubing side there is insufficient pressure differential to cause inhibitor to flow through injection valve 20. Another 58 psi across the valve would place the columns in equilibrium, assuming no pressure drop across the inhibitor injection valve. At a gas lift valve annular pressure of 2200 psi, the annular fluid level would be pushed down 291 ft. If the pressure in the annulus at the gas lift valve is 2600 psi, the level would be lowered an additional 1190 ft. This would still place the liquid level in the annulus at 6806 ft. or 1238 ft. above the packer. This level could be raised by designing pressure drop into the inhibitor injection valve. Thus, the pressure drop across gas lift valve 22 minus the pressure drop across inhibitor injection valve 20 must not be less than approximately 127 psi, but it may be in excess of 624 psi.

Any change in the gas pressure or tubing pressure will cause either a slug of inhibitor or an interruption in inhibitor flow, but if the changes are limited to approximately 200 psi, the interruptions can be tolerated. If the changes occur daily or up to several times per day, the injection will occur in slugs on the same time intervals, which will still give effective inhibition. The inhibitor injection valve must act as a check, since the bottomhole pressure will rise when the well is shut in and the annular pressure will drop if the gas is shut off.

Although the above illustration involves the downhole injection of a corrosion inhibitor, the process of this invention may be employed for the downhole injection of a variety of well-treating chemicals which are in liquid form or which can be placed in liquid form by means of a suitable liquid. Thus, many undesirable downhole conditions which may be modified, relieved or corrected by chemical means may be treated by injecting the chemical active ingredient downhole by the process of the present invention.

What is claimed is:

1. In the production of oil from an oil well by gas lift operations of the type wherein (1) recovery gas is introduced into the annular space between a well casing and a tubing string located within said casing, said tubing string provided with at least one gas lift flow valve intermediate the well head and the wellbore bottom, and (2) gas pressure in the annular space is maintained at a level effective to cause the flow valve to open whereby the recovery gas causes oil to be produced at the well head, the improvement which comprises:

(a) providing a liquid well-treating chemical composition injection valve on said tubing string downhole from the lowermost gas lift flow valve, said well-treating composition injection valve being operatively opened by the pressure difference between the annular space and the tubing string at the location of the well-treating composition injection valve, and (b) during the oil production of step (2), injecting into the annular space a well-treating effective amount of a liquid, well-treating chemical composition said composition providing a liquid head in the annular space effective to cause the well-treating composition injection valve to open and the well-treating composition to pass into the tubing string.

2. A process in accordance with claim 1 wherein the well-treating composition injection valve is located adjacent to the wellbore bottom.

3. A process in accordance with claim 1 wherein the well-treating composition is added to the recovery gas.

4. A process in accordance with claim 1 wherein the upper surface of the liquid head of the well-treating composition is maintained below the location of the lowermost gas lift flow valve.

5. A process according to claim 1 wherein the liquid well-treating chemical composition comprises a corrosion inhibitor, a paraffin control solvent or a scale control chemical as the active ingredient.

6. A process according to claim 5 wherein the liquid well-treating composition comprises a corrosion inhibitor and a liquid carrier.

7. A process in accordance with claim 6 wherein the liquid carrier has a vapor pressure effective to substantially prevent vaporization of said carrier under downhole conditions.

8. A process in accordance with claim 6 wherein the corrosion inhibitor has a vapor pressure effective to substantially prevent vaporization of said corrosion inhibitor under downhole conditions.

9. A process according to claim 5 wherein the liquid well-treating composition comprises a paraffin control solvent.

10. A process according to claim 9 wherein the paraffin control solvent has a vapor pressure effective to substantially prevent vaporization of said paraffin control solvent under downhole conditions.

11. A process according to claim 5 wherein the liquid well-treating composition comprises a scale control chemical and a liquid carrier.

12. A process according to claim 11 wherein the scale control chemical has a vapor pressure effective to substantially prevent vaporization of said scale control chemical under downhole conditions.

13. A process according to claim 11 wherein the liquid carrier has a vapor pressure effective to substantially prevent vaporization of said liquid carrier under downhole conditions.

14. A process according to claim 1 wherein the liquid well-treating chemical composition has a vapor pressure effective to substantially prevent vaporization of said composition under downhole conditions.

* * * * *